US005855135A

United States Patent [19]

Howe

[11] Patent Number: 5,855,135

[45] Date of Patent: Jan. 5, 1999

[54] HORIZONTAL METAL EXTRUSION PRESS

[75] Inventor: Michael Howe, Wesel-Bislich, Germany

[73] Assignee: SMS Eumuco GmbH, Leverkusen, Germany

[21] Appl. No.: 894,306

[22] PCT Filed: Jan. 4, 1996

[86] PCT No.: PCT/DE96/00008

§ 371 Date: Aug. 29, 1997

§ 102(e) Date: Aug. 29, 1997

[87] PCT Pub. No.: WO96/21527

PCT Pub. Date: Jul. 18, 1996

[30] Foreign Application Priority Data

Jan. 11, 1995 [DE] Germany ..... 195 00 555.4

[51] Int. Cl.[6] ..... B21C 23/00

[52] U.S. Cl. ..... 72/253.1; 72/272; 72/456

[58] Field of Search ..... 72/253.1, 272, 72/273, 273.5, 420, 455, 456

[56] References Cited

U.S. PATENT DOCUMENTS

| | | | |
|---|---|---|---|
| 3,431,765 | 3/1969 | Lombard | 72/255 |
| 3,919,878 | 11/1975 | Groos | 72/253.1 |
| 4,308,742 | 1/1982 | Harrison et al. | 72/273.5 |
| 5,062,285 | 11/1991 | Groos | 72/272 |
| 5,421,181 | 6/1995 | Ahrweiler et al. | 72/253.1 |

FOREIGN PATENT DOCUMENTS

| | | | |
|---|---|---|---|
| 379937 | 8/1990 | European Pat. Off. | 72/253.1 |

*Primary Examiner*—Joseph J. Hail, III
*Assistant Examiner*—Ed Tolan
*Attorney, Agent, or Firm*—Herbert Dubno; Andrew Wilford

[57] ABSTRACT

A horizontal metal extrusion press has a pair of relatively stationary end plates spaced apart relative to a press axis and a plurality of spaced parallel tie rods extending parallel to the axis between the end plates, fixing same axially together, and each formed with a support face extending parallel to the axis and lying in a plane forming an acute angle with the horizontal and vertical and generally including the axis. A movable plate is displaceable axially between the end plates and carries a ram. A holder support is carried on one of the end plates and a cylinder carried on one of the end plates and braced against the movable plate for axially displacing same. Respective prismatic-section base bars on the support faces of the tie rods each have a generally vertical guide face and a generally horizontal guide face. These base bars are secured on the respective tie rods for limited movement radially of the axis. Respective vertical adjusters are braced between each of the horizontal guide faces and the movable plate and respective horizontal adjusters independent of the vertical adjusters are braced between each of the vertical guide faces and the movable plate.

3 Claims, 8 Drawing Sheets

HORIZONTAL METAL EXTRUSION PRESS

CROSS REFERENCE TO RELATED APPLICATIONS

This application is the US national phase of PCT application PCT/DE96/00008 filed 4 Jan. 1996 with a claim to the priority of German patent application 195 00 555.4 itself filed 11 Jan. 1995.

FIELD OF THE INVENTION

The present invention relates to a horizontal metal extrusion press. More particularly this invention concerns a mounting system for the sliding parts of such a press.

BACKGROUND OF THE INVENTION

Horizontal metal extrusion presses are normally provided with a press frame formed by a cylinder plate, a counter plate, and at least four tie rods therebetween. It is significant for compact construction that the tie rods act as guides for the support holder and the movable plate which are shiftable in the press frame along the press axis (German patent 2,366,117). Such direct guiding on the tie rods allows one to dispense with a base frame functioning as a guide (German patent 644,174, German published application 2,003,244).

The support of the support holder and also of the movable plate is usually on support faces that are set at an angle so that their extension cuts the press axis or lies near the press axis, that is they point toward the press axis to ensure a centered position of the holder and the ram that will not be influenced by thermal expansion caused by temperature changes. In order to centrally position the holder and the ram on the press axis supports are arranged with a base frame supporting the guides for the support holder and the movable plate between the guides and the base frame, these supports being adjustable horizontally on the base frame perpendicular to the press axis and being vertically adjustable relative to the guides (German patent 644,174).

When dispensing with the base frame acting as guide frame and forming the tie rods as guides for the support holder and the movable plate, the supports must be eliminated and the adjusters must be arranged to be effective perpendicularly to the support surfaces oriented on the press axis in the support holder and movable plate, as this is done in a support holder guided by a press frame in German 1,452,264, and also in an extrusion press provided with a base frame formed as a guide frame as in German published application 2,003,244. This arrangement of the adjusters perpendicular to the support surfaces oriented on the press axis has the disadvantage that the adjustment always works out to vertical and horizontal components that must be compensated for by a displacement of the slide shoe of the adjuster riding on the support surface transverse to the displacement direction of the support holder and movable plate. Actuation of the adjusters is first done in setting up the extrusion press when the support holder and movable plate are at rest so that as a result of friction between the slide shoes and the support surfaces an offset either does not take place at all or only somewhat on displacement of the holder or of the movable plate, thereby making adjustment of the extrusion press more difficult.

When the extrusion press is calibrated only when it is warmed up, later temperature changes are lost along with the heat expansions which arrangement of the support surfaces for the support holder and movable plate relative to the press axis are intended to correct. As a result this arrangement is to be maintained. The press frame formed of cylinder plate, counter plate, and tie rods therebetween undergoes an elastic deformation such that the cylinder plate and counter plate bow outward and the tie rods bow inward, although this is minimized but not eliminated by the considerable rigidity of the cylinder plate and counter plate. Since the elimination of a base frame forming a guide frame results in the guiding of the support holder and the movable plate by the tie rods, the arrangement of the support surfaces on the tie rods oriented to the press axis is necessary.

OBJECTS OF THE INVENTION

It is an object of the present invention to improve on the metal extruding press described immediately above.

Another object is to improve in such a press the adjustability of the support holder and movable plate relative to the tie rods on which they are guided.

SUMMARY OF THE INVENTION

A horizontal metal extrusion press has a pair of relatively stationary end plates spaced apart relative to a press axis and a plurality of spaced parallel tie rods extending parallel to the axis between the end plates, fixing same axially together, and each formed with a support face extending parallel to the axis and lying in a plane forming an acute angle with the horizontal and vertical and generally including the axis. A movable plate is displaceable axially between the end plates and carries a ram. A holder support is carried on one of the end plates and a cylinder carried on one of the end plates and braced against the movable plate for axially displacing same. Respective prismatic-section base bars on the support faces of the tie rods each have a generally vertical guide face and a generally horizontal guide face. These base bars are secured on the respective tie rods for limited movement radially of the axis. Respective vertical adjusters are braced between each of the horizontal guide faces and the movable plate and respective horizontal adjusters independent of the vertical adjusters are braced between each of the vertical guide faces and the movable plate.

The base bars can be so long that they extend the full length of the distance along the press axis through which the support holder and movable plate are shifted on the tie rods so that the adjusters are provided with slide shoes that sit on and slide along the horizontal and vertical guide faces of the base bars.

The base bars can also be formed as short slide shoes, about the same length as the brackets, and mounted on their brackets and on the horizontal and vertical adjusters for sliding with the support holder and movable plate along the press axis.

In view of the above, the bowing of the tie rods caused by the elastic deformation of the press frame by an inwardly oriented arrangement relative to the press axis of the support surfaces on the tie rods being rendered ineffective, it is of particular advantage that according to a further feature of the invention the support surfaces on the tie rods run parallel to the plane defined by the press axis and the center axis of the respective tie rod.

BRIEF DESCRIPTION OF THE DRAWING

The above and other objects, features, and advantages of the invention will be more closely described below with reference to the drawing in which.

SPECIFIC DESCRIPTION

Figure 1:
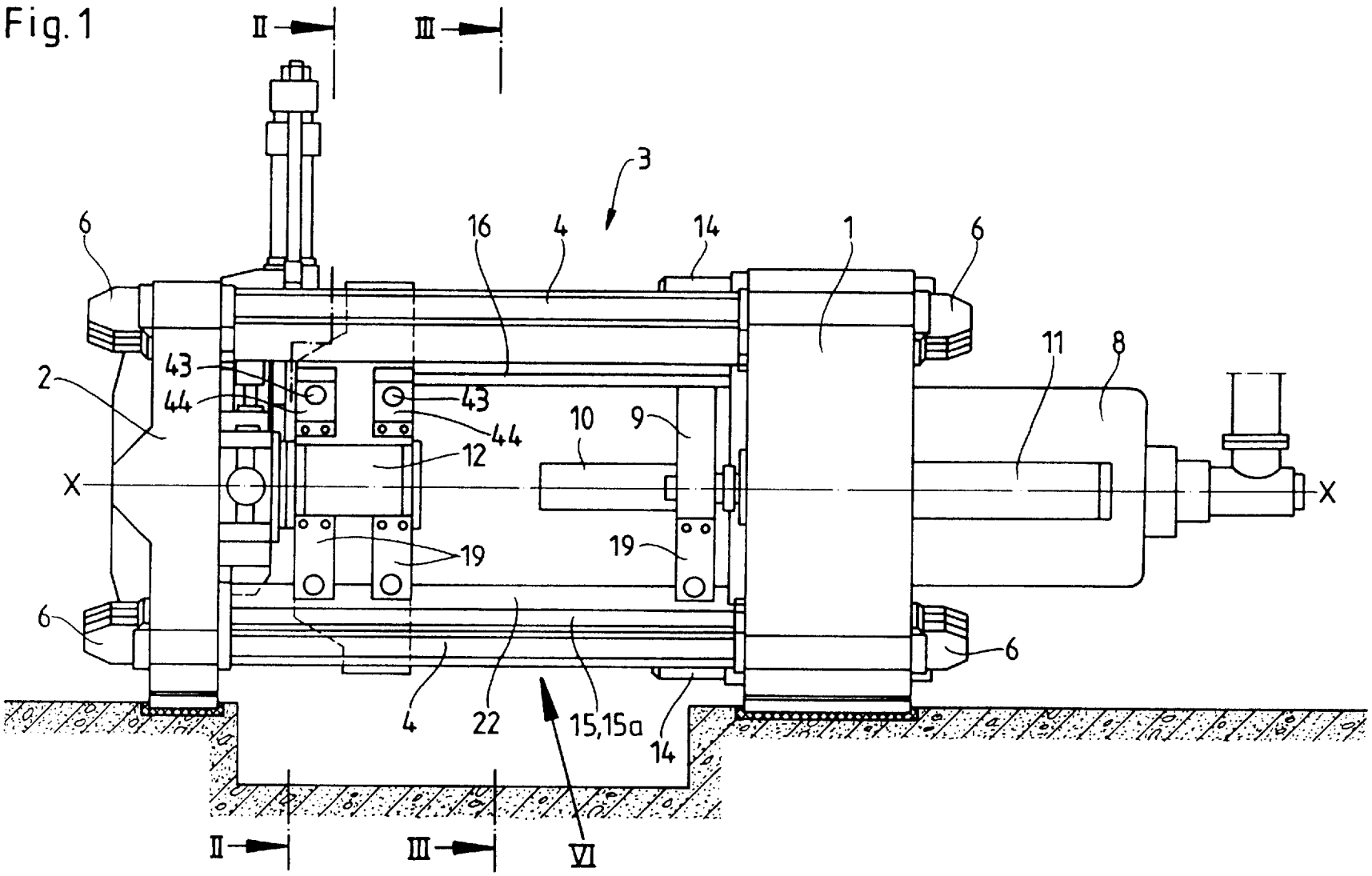
FIG. 1 is a side view partly in vertical section of the press according to the invention.

The embodiment shown in FIGS. 1 through 6 of a metal extrusion press comprises a cylinder plate 1, a counter plate 2, and tie rods 4 joining them together as a press frame 3. The tie rods 4 are formed as shrink anchors and are each comprised of several tension bars 5 having hammer heads 6 which engage the plates (cylinder plate 1 and counter plate 2) and of multipart rectangular-section pressure rods 7 which are engaged between the plates. The rectangular pressure rods 7 are hollow. On assembly of the press frame 3 the tension bars 5 are prestressed against the rectangular pressure rods 7. This known construction from German 2,331,318 imparts considerable structural stability to the press frame.

Connected to the cylinder plate 1 is a cylinder 8 in which a piston is connected with the movable plate 9 for a pressing operation, the movable plate 9 moving along the press axis X—X and carrying a ram 10. Retractors 11 are provided for pulling back the movable plate 9. Also movable in the direction of the press axis X—X is a holder support 12 of a holder 13 for metal ingots to be extruded. The holder support 12 is moved by piston/cylinder units 14. On their movement along the press axis X—X the movable plate 9 and the holder support 12 are guided by the tie rods 4 on their rectangular pressure rods 7 surrounding the tension bars 5 and at least the lower ones are provided with guide bars 15 in order to support the movable plate 9 and the holder support 12 and also the upper ones can have guide bars 16—as in the embodiment—in order to hold down the holder support 12 and also the movable plate 9.

The holder support 12 is provided with outriggers 17 and the movable plate 9 with outriggers 18 which form brackets or—as in the embodiment—are provided with brackets 19. The brackets 19 are provided with vertical adjusters 20 and horizontal adjusters 21 by means of which they engage prismatic base bars 22 which lie on support surfaces 15*a* running parallel to the press axis on the guide bars 15.

Figure 4:
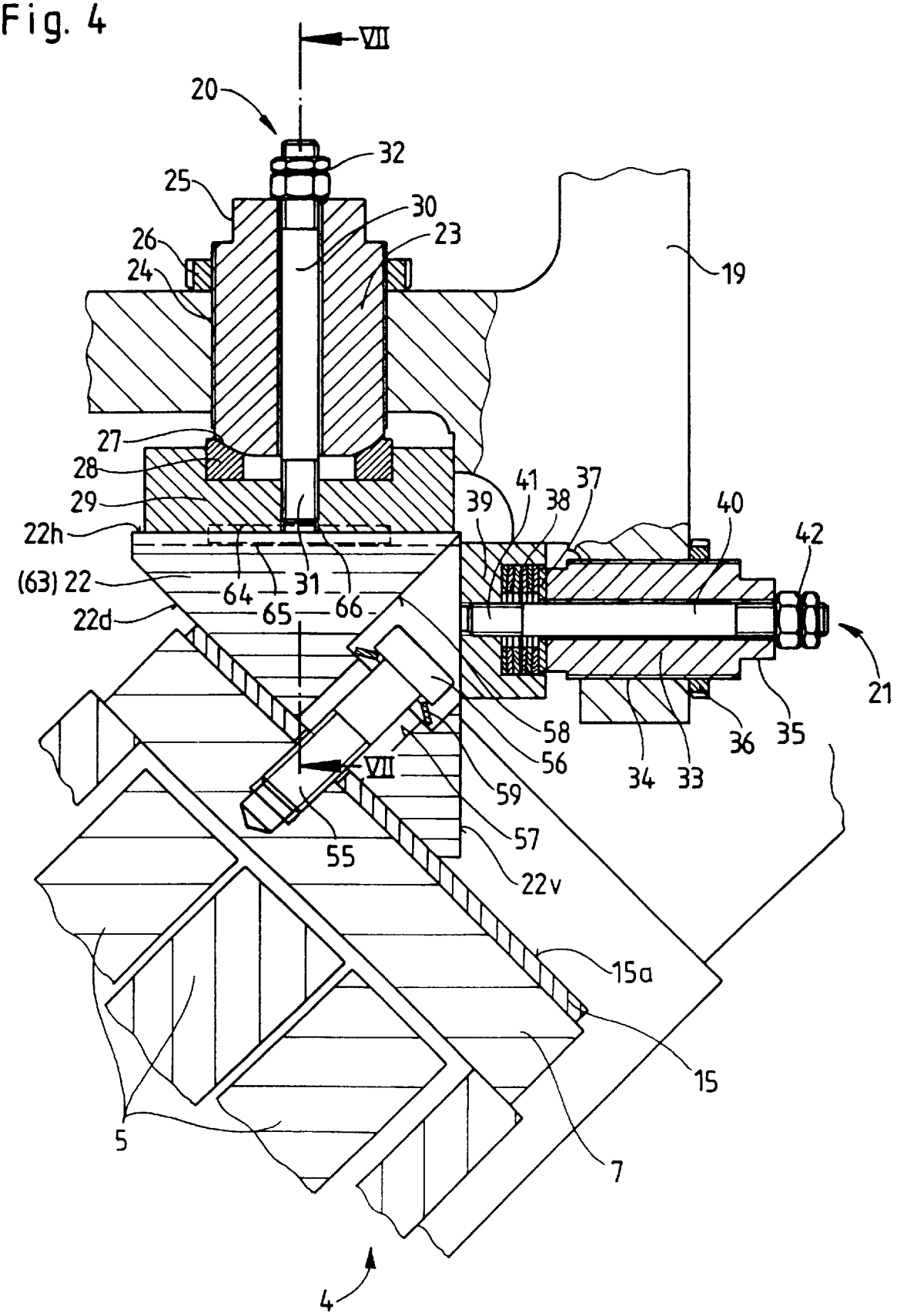
FIGS. 4 and 5 are large-scale views of the details indicated at IV and V in FIG. 3.

Shown in detail in FIG. 4 are a vertical adjuster 20, a horizontal adjuster 21, and a base bar 22 gripped by them and having a horizontal guide face 22*h*, a vertical guide face 22*v*, and a diagonal face 22*d*.

The vertical adjuster comprises a threaded bolt 23 which is screwed into a threaded bore 24 of the bracket 19 and which is provided with tool facets 25. The threaded bolt 23 is vertically lockable by means of a lock nut 26. The bolt 23 bears on the support surface 15*a* of one of the tie rods 4 by means of its lower part-spherical end face 27 via a pressure ring 28, a slide shoe 29, and the base bar 22 on whose horizontal guide face 22*h* the slide shoe 29 bears with its diagonal guide face 22*d*. The pressure ring 28 and the slide shoe 29 with the bolt 23 are held in place by an anchor bolt 30 which traverses a bore in the bolt 23 and is connected with the slide shoe 29 by its thread 31 and held in place by a nut 32.

The horizontal adjuster 21 comprises a threaded bolt 33 which is screwed into a threaded bore 34 of the bracket 19 and which is provided with tool facets 35. The threaded bolt 33 is horizontally lockable by means of a lock nut 36. The bolt 33 bears by means of a slide shoe 39 on the vertical guide face 22*v* of the base bar 22. Although direct engagement of the slide shoe 39 with the bolt 33 is possible, according to the invention this takes place via a pressure disk 37 and a stack of spring washers 38. An anchor bolt 40 connected by a screwthread 41 with the slide shoe 30 holds the slide shoe 39 in position on the bolt 33 which is provided with a bore traversed by the anchor bolt 40. The spring washers 38 are prestressed so much by means of the threaded nuts 42 that the resultant of the perpendicular force (weight of the support holder with the holder or the movable plate) and the bracing of the base bar 22 on the support face 15*a* inclined to the press axis constitutes the prestressing.

Figure 8:
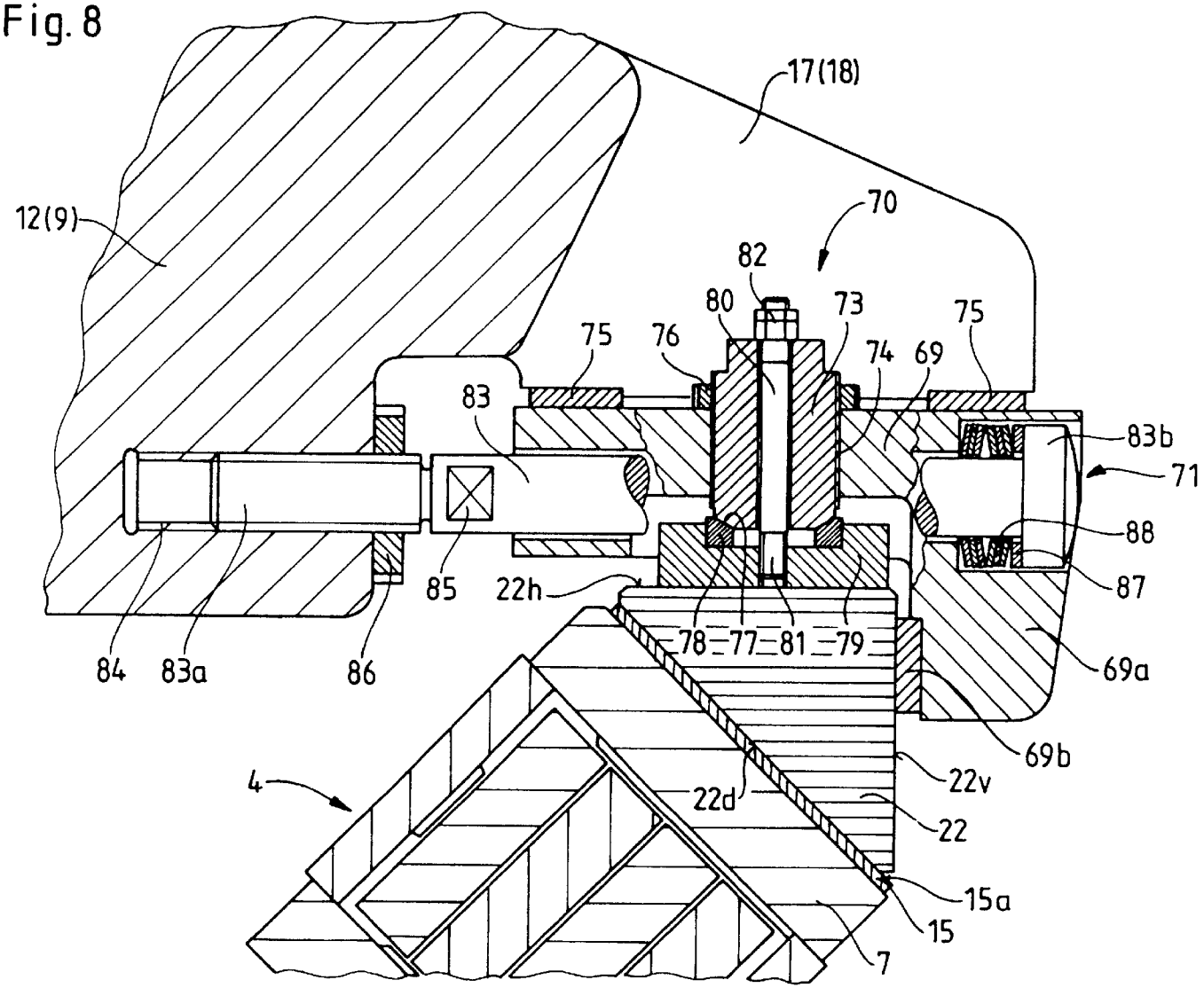
FIG. 8 is a view like FIG. 4 of another variant on the invention.

Similar to the embodiment of FIG. 4, in the embodiment of FIG. 8 there is a base bar 22 with a horizontal guide face 22*h*, a vertical guide face 22*v*, and a diagonal guide face 22*d*, the base —bar 22 bearing with its diagonal face 22*d* on the support face 15*a* of the guide bar 15 and therethrough on the pressure rod 7 of the tie rod 4. The vertical adjuster 70 is a threaded bolt 73 which is screwed into a threaded bore 74 of a slide part 69. A lock nut fixes the bolt 73 in its vertical position. The bolt 73 bears via its lower part-spherical end face 77, a pressure ring 78, and a slide shoe 79 on the horizontal guide face 22*h* of the base bar 22. An anchor bolt 80 which traverses a bore of the bolt 73 and which is seated with its thread 81 in the slide shoe 79 holds the pressure ring 78 and the slide shoe 79 with the threaded bolt 73 by means of the threaded nut 82. The outriggers 17 of the holder support 12 provided with the slide bar 75 or the outriggers 18 of the movable plate 9 are braced on respective slide parts 6 and via the threaded bolt 73, the pressure ring 78, and the slide shoe 79 on the base bar 22 and are adjustable vertically by means of the bolt 73. The slide piece 69 is provided with an upright extension 69*a* which is provided with a slide piece 69*b* with which the slide piece 69 lies on the vertical face 22*v* of the base bar 22. To horizontally align the support holder 12 or the movable plate 9 there are adjustment means 71 between each slide piece 69 and the support holder 12 or slidable plate 9. Each adjustment means 71 comprises a threaded spindle 83 whose threaded part 83*a* is screwed into a bore 84 in the support holder 12 or plate 9 so as to be adjustable and lockable by means of a lock nut 86.

Tool facets 85 are provided for rotating the spindle 83. The head 83*b* of the spindle 83 bears on the slide piece 69 via a pressure disk 87 and a stack of spring washers 88. The embodiment according to FIG. 8 has the advantage that the elements for horizontally adjusting the support holder 12 or movable plate 9 project less far past the tie rod 4 and are therefore more protected. This embodiment is particularly suitable for a motor-powered drive of the adjustment means 70 and 71 as opposed to a manual system.

Figure 5:
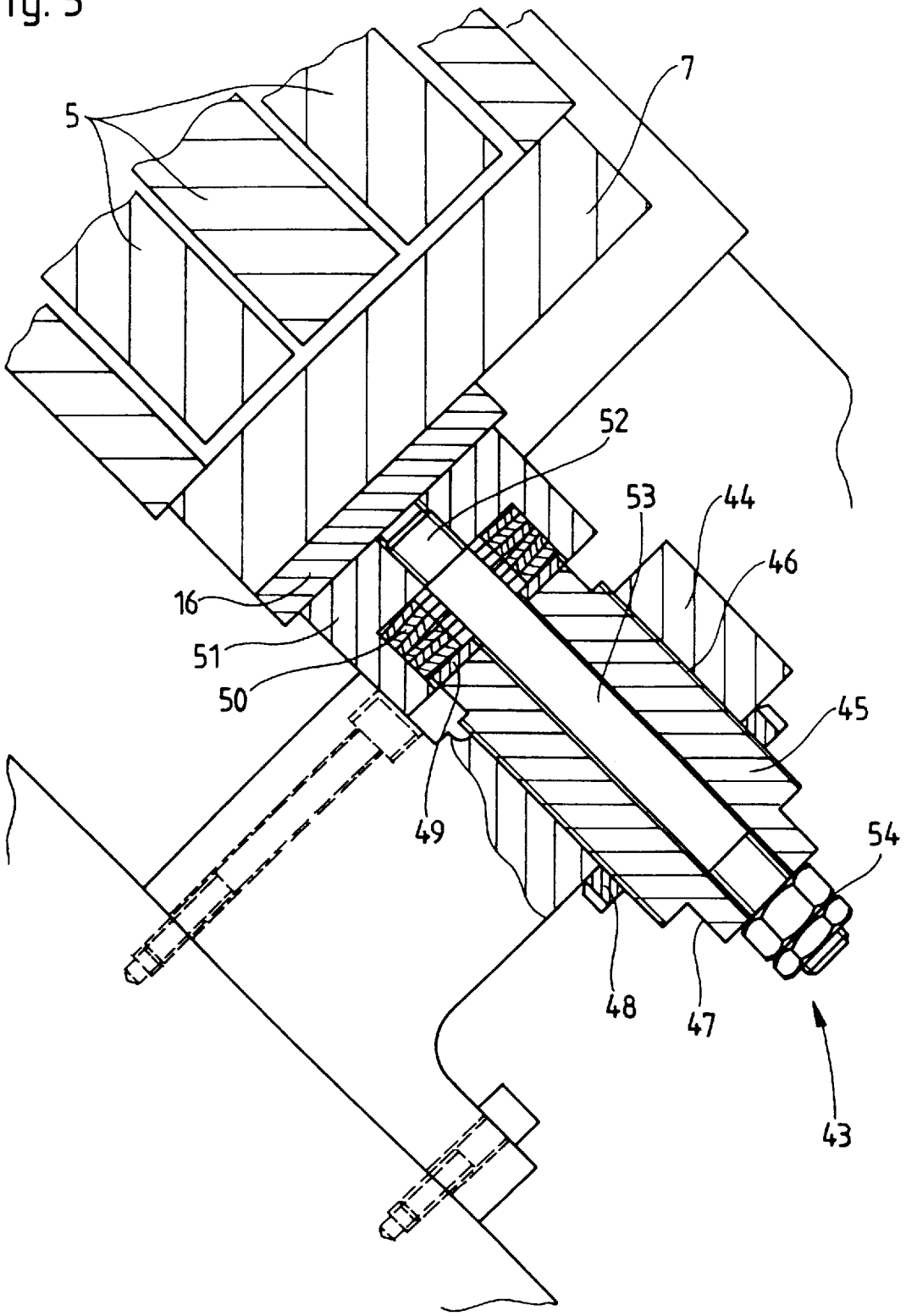

FIG. 5 shows in detail a hold-down 43 that slides with the support holder 12 along the upper guide bar 16. The hold-downs 43 are mounted in brackets 44 fixed on the holder support 12. The hold-down 43 comprises a threaded bolt 45 which is screwed into a threaded bore 46 in the bracket 44 and provided with tool facets 47. A lock nut 48 locks the bolt 45 in place. The bolt 45 bears via a slide disk 49 and a stack of spring washers 40 on the slide shoe 5 which bears on the guide bar 16 and thus holds the support holder 12 down with the force of the springs 50. An anchor bolt 53 connected with the slide shoe 51 by a screwthread 52 traverses a bore in the bolt 45 and holds the bolt 45, the slide disk 49, the spring washers 50, and the slide shoe 51 together by means of the threaded nut 54 so that the hold-down force is determined by the position of the bolt 45 in the bracket 44.

Figure 2:
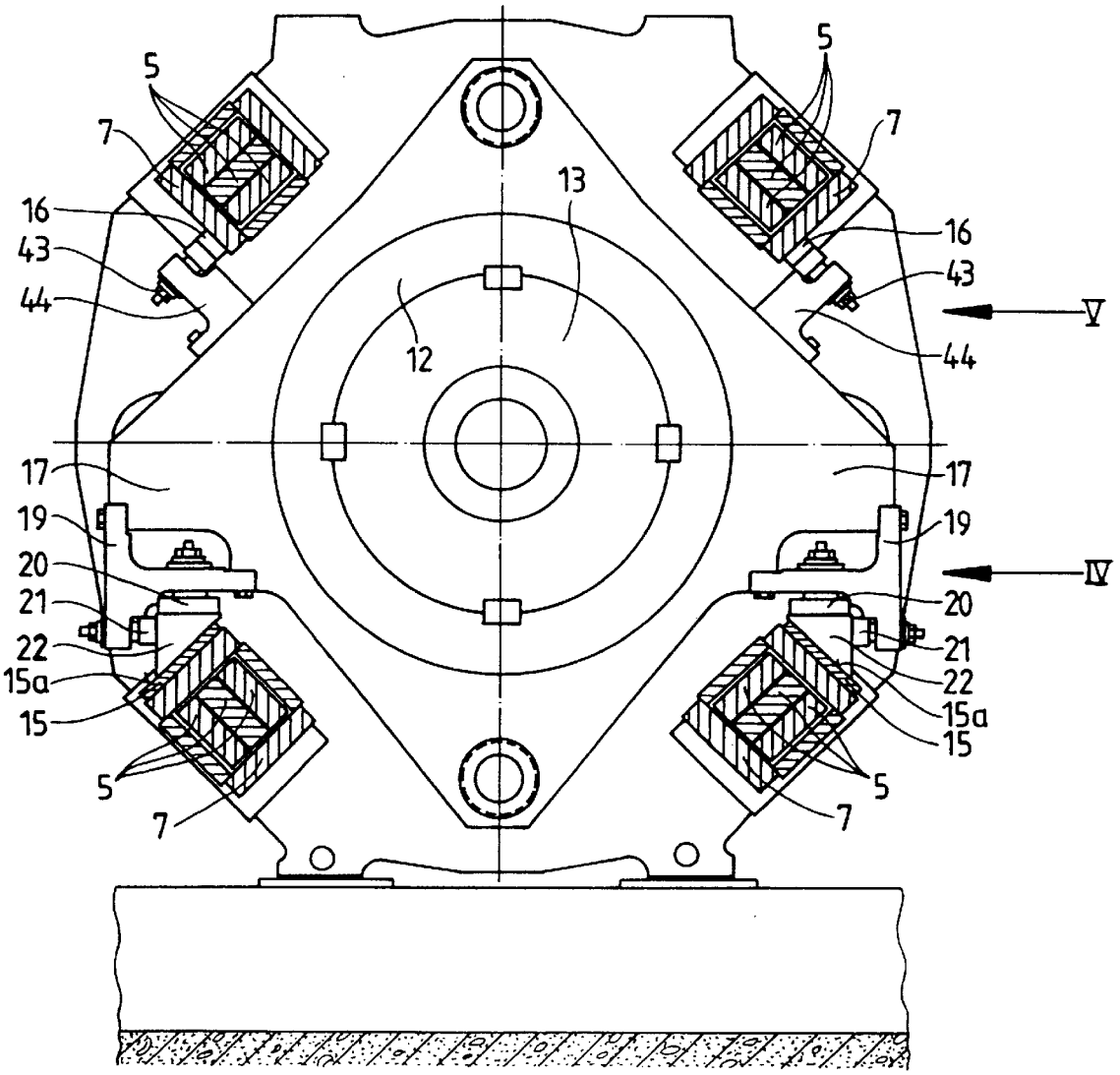
FIGS. 2 and 3 are sections taken along respective lines II—II and III—III of FIG. 1.
Figure 3:
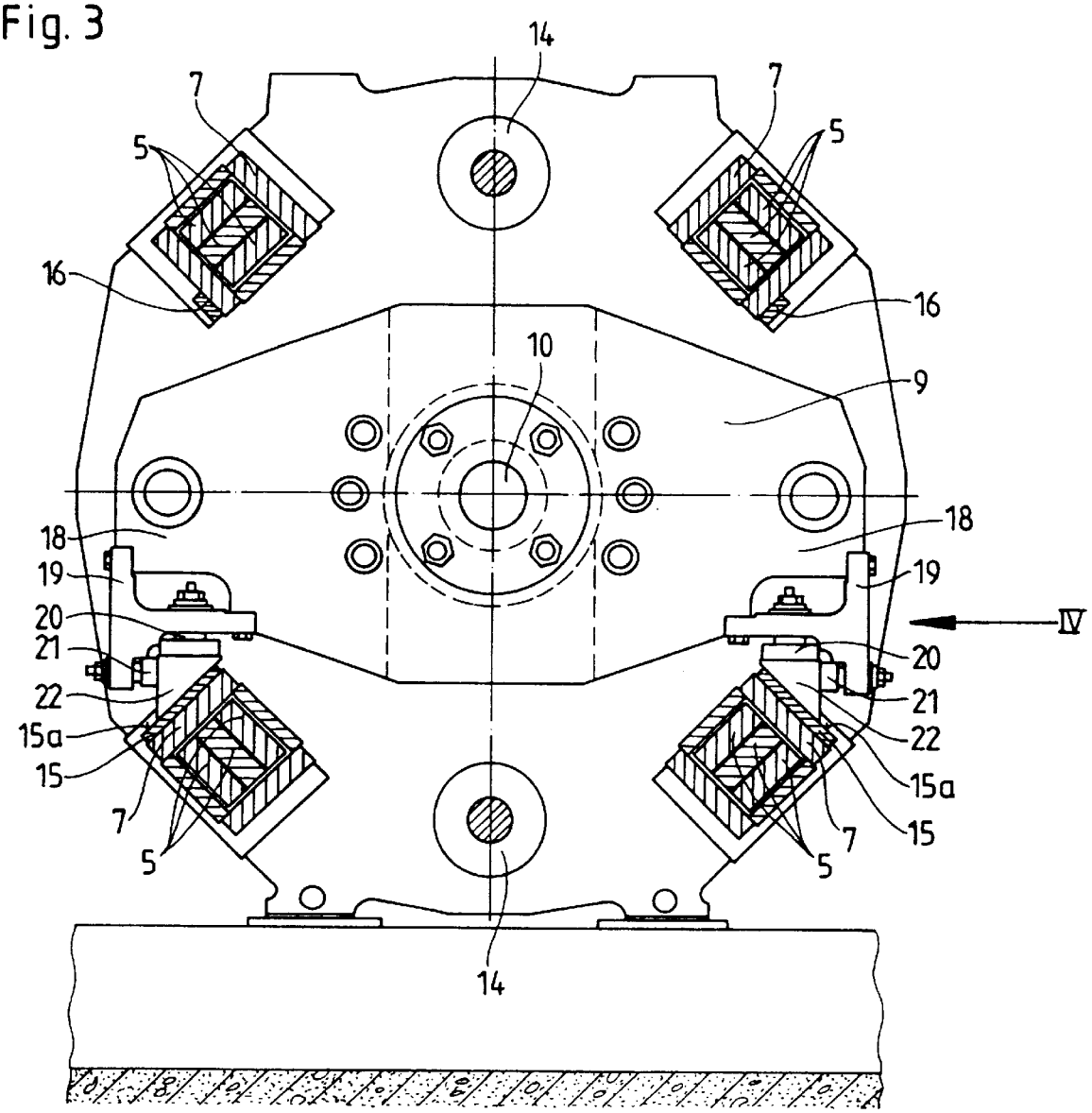
Figure 6:
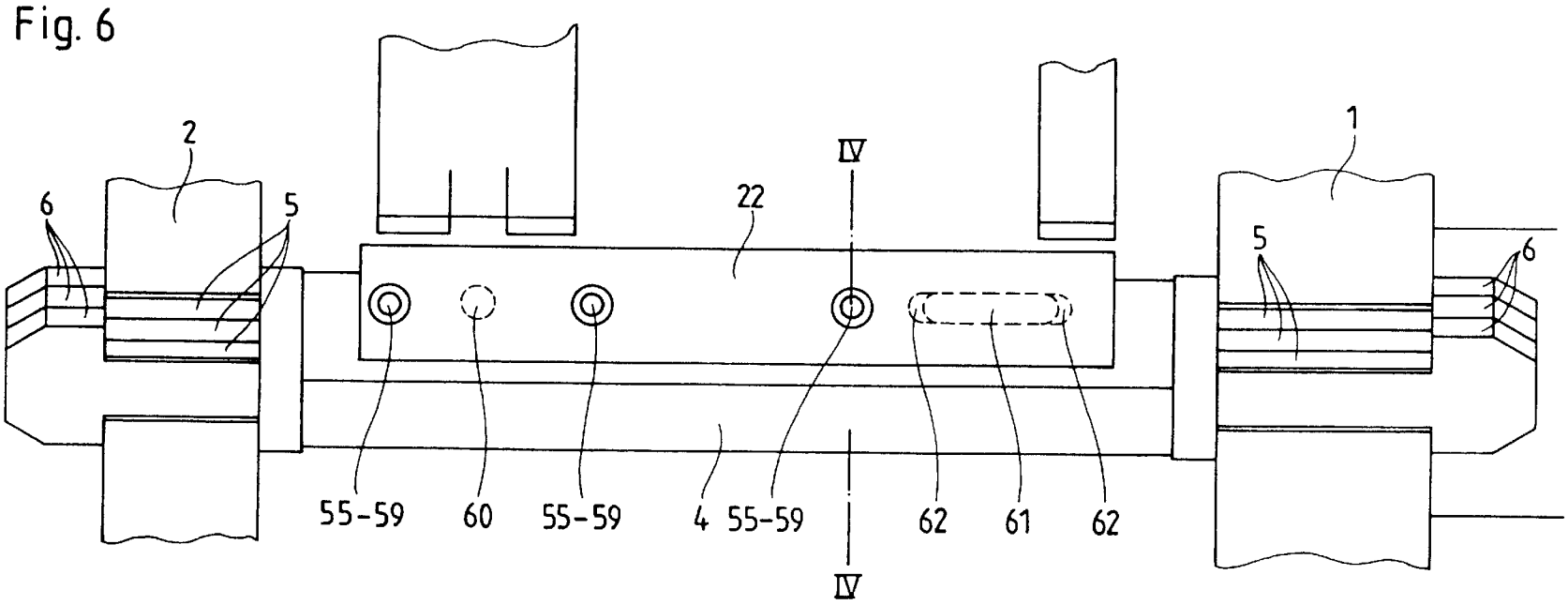
FIG. 6 is a large-scale view of the detail indicated at VI in FIG. 1.

The schematic representation in FIG. 6 shows a base bar 22 which extends over the entire region of the support holder 12 and of the movable plate 9. The base bar 22 is held—as shown in FIG. 2—by screws 55 whose heads are recessed in the base bar 22. The bores 57 and 58 are somewhat bigger than the screws 55 and screwheads 56 so that play is provided for the movements of operation of the pressure rods 7 of the tie rods 4 and expansion differences between these elements. In order to limit the shifting force there are spring washers 59 under the screw heads 56.

When—as mentioned—the extrusion press is heated up and ready to work, thermal expansions as a result of temperature changes can be ignored and one need only pay attention to the elastic deformations of the press frame 3 caused by the pressing force. These are effective far from the cylinder plate 1 and counter plate 2, that is in the middle of the tie rods 4. Under these circumstances it is possible to fix the base bars 22 in the region of the cylinder plate and counter plate 2 transversely to the pressing direction, the mounting at one end—in the illustrated embodiment at the end near the counter plate 22—being done by a pin 60 and at the other end by a key 61 with the expansion differences between the base bars 22 and the tie rods 4 being the longitudinal play 62. In the end regions there is such guiding, a flat engagement and an X-guiding.

Figure 7:
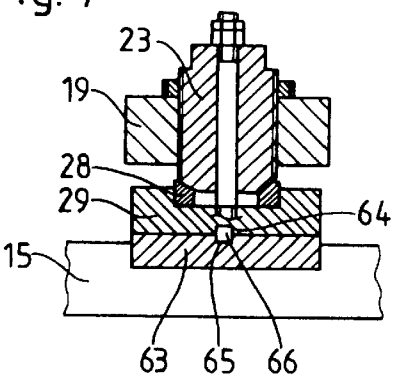
FIG. 7 is a sectional view corresponding to section line VII—VII of FIG. 4 but of a variant on the invention.

In the modification shown in FIG. 7 base bars 63 are provided whose lengths are limited to the width B of the brackets 19. They slide on shifting of the support holder 12 or of the movable plate 9 on the guide bars 15 and thus are coupled for joint movement in the displacement direction with their brackets 19. Here in the embodiment the slide shoe 29 and also the base bar 63 are provided with a groove 64 extending perpendicular to the displacement direction on the slide shoes 29 and 65 on the base bar 63 in which the key 66 works as a coupling element (in this regard see the dotted representation of FIG. 4).

Figure 11:
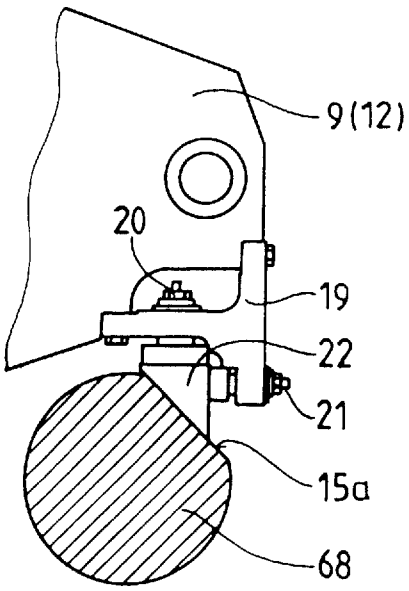
FIGS. 9, 10, and 11 are small-scale cross sections illustrating further variants on the present invention.
Figure 10:
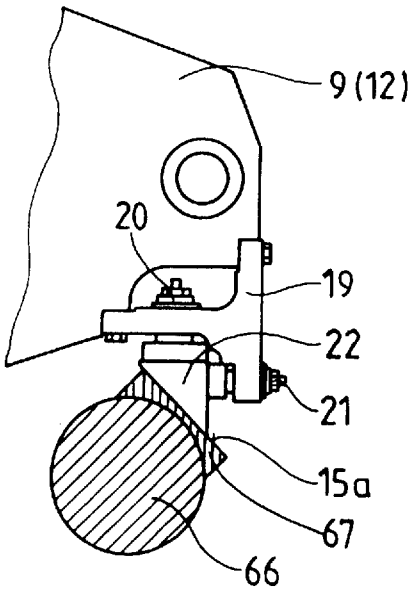
Figure 9:
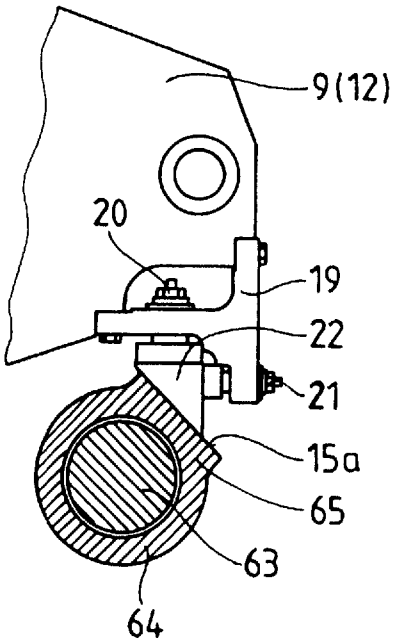

The tie rods 4 in the embodiments of FIGS. 1 through 8 are made up of tension bars 5 and rectangular pressure rods 7. This construction is advantageous because of its particular rigidity but is not essential to the invention as shown in FIGS. 9 through 11. With the frame style shown in FIG. 9 round tie rods 63 are prestressed with respect to tubular pressure elements 64 arranged between the cylinder plate 1 and counter plate 2. Support faces 15*a* oriented parallel to the press axis are provided on a longitudinal thickening 65. In the embodiments according to FIGS. 10 and 11 simple round rods that are not prestressed are provided as tie rods, the round rod 66 in FIG. 10 being provided with an added bar 67 that forms the face 15*a* while the round rod 68 of FIG. 11 is provided with a flat forming the surface 15*a*.

The vertical adjusters 20 and 70 and the horizontal adjusters 21 and 71 as well as the hold-downs 43 are set up for manual adjustment according to the illustrated embodiments. By using known—for example from German 3,020,156, European 0,379,937, or European 0,589,240—measuring devices for monitoring the central orientation of the press parts and in conjunction with motorized drives for the adjusters 20, 70, 21, 71 and hold-downs 43 their position can also be set by a computer using the measured values.

I claim:

1. A horizontal metal extrusion press comprising a pair of relatively stationary end plates spaced apart relative to a press axis;

a plurality of spaced parallel tie rods extending parallel to the axis between the end plates, fixing same axially together, and each formed with a support face extending parallel to the axis and lying in a plane forming an acute angle with the horizontal and vertical and generally including the axis;

a movable plate displaceable axially between the end plates;

a ram carried on the movable plate;

a holder support carried on one of the end plates;

a cylinder carried on one of the end plates and braced against the movable plate for axially displacing same;

respective prismatic-section base bars fixed on the support faces of the tie rods and each having a generally vertical guide face and a generally horizontal guide face, the faces extending generally a full axial distance between the end plates;

a respective vertical adjuster braced between and movable axially along each of the horizontal guide faces and carried on the movable plate; and a respective horizontal adjuster independent of the respective vertical adjuster and braced between and movable axially along each of the vertical guide faces and carried on the movable plate.

2. The improved extrusion press defined in claim 1 wherein each adjuster includes a slide shoe riding on the respective guide face.

3. The improved extrusion press defined in claim 1 wherein each support face is parallel to a plane including the press axis and a center axis of the respective tie rod.

* * * * *